US006486396B2

(12) United States Patent
Stein

(10) Patent No.: US 6,486,396 B2
(45) Date of Patent: Nov. 26, 2002

(54) ELECTRIFIED TELESCOPING WAND FOR VACUUM CLEANER

(75) Inventor: Thomas Stein, Velbert (DE)

(73) Assignee: Stein & Co. GmbH, Velbert (DE)

( * ) Notice: Subject to any disclaimer, the term of this patent is extended or adjusted under 35 U.S.C. 154(b) by 0 days.

(21) Appl. No.: 09/925,891

(22) Filed: Aug. 9, 2001

(65) Prior Publication Data

US 2002/0020541 A1 Feb. 21, 2002

(30) Foreign Application Priority Data

Aug. 9, 2000 (DE) ..... 100 38 740

(51) Int. Cl.[7] ..... F16L 11/12; A47L 9/24

(52) U.S. Cl. ..... 174/47; 285/7; 15/377; 15/410

(58) Field of Search ..... 174/47; 15/377, 15/410; 285/7

(56) References Cited

U.S. PATENT DOCUMENTS 3,961,647 A * 6/1976 Doubleday ..... 138/103
4,277,640 A * 7/1981 Kutnyak et al. ..... 174/47
4,319,380 A * 3/1982 Simm et al. ..... 15/144.4
4,368,348 A * 1/1983 Eichelberger et al. ..... 138/111
4,494,270 A * 1/1985 Ritzau et al. ..... 15/377
4,989,295 A * 2/1991 Guhne et al. ..... 15/144.4
5,462,311 A * 10/1995 Cipolla ..... 285/24
5,740,583 A * 4/1998 Shimada et al. ..... 15/377
5,836,620 A * 11/1998 Wang et al. ..... 285/302
6,148,474 A * 11/2000 Ohara et al. ..... 15/377
6,353,178 B1 * 3/2002 Linhart ..... 138/138

* cited by examiner

*Primary Examiner*—Dean A. Reichard
*Assistant Examiner*—Adolfo Nino
(74) *Attorney, Agent, or Firm*—W. F. Fasse; W. G. Fasse

(57) ABSTRACT

A vacuum cleaner wand includes inner and outer relatively telescopable pipes, a cord magazine chamber on the outer pipe, a sheath tube connected to the inner pipe and slidably extending into the chamber, a slider guided slidably parallel to the sheath tube in the chamber, and a flexible electrical cord. The cord extends along inside the sheath tube, bends 180° as a fixed loop at an end of the sheath tube, extends back between the sheath tube and the slider, bends 180° as a movable loop through an opening in the slider, and extends between the slider and a sidewall of the chamber. Thereby the cord has an adjustable extended length corresponding to the selected telescoped length of the wand. The sliding sheath tube slides the cord, which in turn moves the slider, so that the cord remains kink-free.

25 Claims, 3 Drawing Sheets

ELECTRIFIED TELESCOPING WAND FOR VACUUM CLEANER

PRIORITY CLAIM

This application is based on and claims the priority under 35 U.S.C. §119 of German Patent Application 100 38 740.3, filed on Aug. 9, 2000, the entire disclosure of which is incorporated herein by reference.

FIELD OF THE INVENTION

The invention relates to a telescoping wand for a vacuum cleaner, including an inner suction pipe slidably arranged in an outer suction pipe to allow a telescoping adjustment thereof, and a variably extendable electrical cord or cable to allow electrically powered accessories, such as an electric carpet beater brush, to be connected to the telescoping wand and receive electrically power directly therefrom.

BACKGROUND INFORMATION

It is commonly known to provide various accessories that can be connected to an extension wand or floor wand of a vacuum cleaner, and to provide such accessories with electrical power through an electrical cord or cable that is connected to or incorporated in the wand. One known arrangement involves simply securing an electrical cable somewhat loosely on the outside of the vacuum hose and the extension wand. Such an arrangement is neither very functional nor aesthetically satisfactory.

It is further known to provide two-part telescoping vacuum wands, which are telescopably adjustable in length, to provide a comfortable height or extension length for the particular user of the vacuum cleaner. An electrical cable may be incorporated into such telescoping wands in various conventional manners. In one known arrangement, a tubular chamber is provided running parallel to the vacuum pipe of the telescoping wand, whereby this tubular chamber is also embodied in a telescoping manner and houses an extendable spiral cord or cable. In another known arrangement, a flat chamber is provided on the outside of the vacuum pipe of the telescoping wand, and a flexible electrical cord or cable is guided over a spring-loaded pulley arrangement or block-and-tackle arrangement, whereby the cable is pulled out of this mechanism along with the telescoping extension of the wand. Such an arrangement is disclosed, for example, in German Patent Publication DE 195 35 493 A1.

In practice it has been found that the known arrangements of a variably extendable electrical cord for a telescopably extendable vacuum wand are rather complicated and costly to manufacture, rather prone to failure and thus requiring maintenance and repair during the operating life of the vacuum cleaner, and also require a relatively large space, giving the complete wand arrangement a bulky configuration and appearance.

SUMMARY OF THE INVENTION

In view of the above, it is an object of the invention to provide a simplified arrangement of a length-adjustable, adaptable, compact, and functionally robust and reliable electrical connection for supplying electrical power to accessory devices connected to the end of a telescoping extension wand of a vacuum cleaner. It is a further object of the invention to provide such an arrangement that has relatively small dimensions to extend unobtrusively along the telescoping wand. Yet another object is to ensure that such an arrangement meets all international standards relating to the required electrical insulation and reliability. The invention further aims to avoid or overcome the disadvantages of the prior art, and to achieve additional advantages, as apparent from the present specification.

The above objects have been achieved according to the invention in a telescoping vacuum wand arrangement for a vacuum cleaner, including an inner vacuum pipe slidingly arranged within an outer vacuum pipe, a magazine chamber or cord reserve storage chamber running lengthwise along the outer vacuum pipe, a cord receiver element that is coupled to the inner vacuum pipe and slidable into and out of the magazine chamber, a slider that is longitudinally slidably arranged and guided within the magazine chamber, and an electrical cable or cord. The cord is fixed to the inner vacuum pipe at a first end of the wand, and from there is received and extends along the cord receiver element into the magazine chamber. At an end of the receiver element within the magazine chamber, the cord forms a first fixed loop that is fixed to the cord receiver element. From there, the cord runs back along the receiver element and particularly between the receiver element and the slider that is slidably guided parallel to the receiver element, to a cord guide opening of the slider. There, the cord forms a second movable or unfixed loop that passes through the cord guide opening, e.g. a hole in the slider or an end guide of the slider. From there, the cord extends along the opposite side of the slider to a fixed end of the cord at a second end of the telescoping wand. In this manner, the cord zig-zags back-and-forth in two opposite directions parallel to the longitudinal axis of the wand, to form a general Z- or S-shape of the cord (called a "meandering shape" herein) within the magazine chamber, more particularly as follows.

With the above arrangement according to the invention, the cord receiver element slidably moves indirectly with the inner vacuum pipe and thereby carries out a telescoping motion relative to the magazine chamber, together with the telescoping motion of the inner vacuum pipe relative to the outer vacuum pipe. The cord forms a U-shaped loop that is fixed or secured to the free end of the cord receiver element protruding into the magazine chamber, and the cord is also fixed or secured at the second end of the wand. Between these secured points, the cord meanders in the form of another U-shaped loop over or through a guide of the slider. This back and forth meandering or looping of the cord provides an adjustable length reserve or supply of the electrical cord, of which the longitudinal extension length depends on the relative positions and relative overlap of the slider and the cord receiver element. Thereby, the cord length is adaptable to different telescoping length adjustments of the telescopable vacuum wand.

Suitable electrical connectors, couplers, or contact receivers are provided respectively at the ends of the inner vacuum pipe and the outer vacuum pipe, to allow the electrical cord to be connected to a desired accessory device on the one hand, and to a source of electrical power, for example preferably provided through an electrified vacuum hose from the vacuum cleaner itself, on the other hand.

A first cord guide channel is formed between the slider and the cord receiver element, while a second cord guide channel is formed on the opposite side of the slider, between the slider and a side wall of the magazine chamber. The cord is respectively guided in these guide channels on opposite sides of the slider. The guide channels are properly dimensioned, so that the cord is guided and supported while slidingly shifting therein in a kink-free manner. Moreover, preferably, the dimensions are such that the sliding displacement of the cord receiver element slidingly pulls and pushes the cord (depending on the direction of motion of the cord receiver element relative to the magazine chamber), and thereby correspondingly transmits a tension-pulling force and a thrust-pushing force through the cord (especially through the movable second cord loop) onto the slider. As a result, this causes the slider to slidingly move within the magazine chamber as the cord receiver element is extended from or retracted into the magazine chamber.

In the above manner, no other mechanisms are required for properly moving the slider. Alternatively, a tension spring or compression spring may slidingly bias the slider to urge the slider toward the first end of the telescoping wand. As mentioned above, however, in the preferred simplest embodiment, such a biasing spring or other biasing means can be completely omitted due to the pushing and pulling sliding force being transmitted from the cord receiver element through the cord to the slider. This force transmission is especially provided through the movable second cord loop passing through (and bearing against) the cord guide opening of the slider, but may additionally include a force transmission component that is transmitted frictionally by the cord rubbing along the side of the slider facing the cord receiver element.

In this manner, the invention achieves a very simple, robust and reliable arrangement of a freely length-adjustable or adaptable electrical cord, with a relatively compact length and width dimension. Moreover, the electrical cord is stored in a back-and-forth looping fashion and is thereby positively guided in a block-and-tackle type arrangement and motion for achieving a required length adjustment, without needing any special means for moving the various components or the like. Namely, with the simple freely-sliding slider and the cord receiver element, the invention avoids the need for plural block-and-tackle elements and their suitable coupling to each other that would otherwise typically be needed for a block-and-tackle arrangement. The above mentioned sliding force initiated by the cord receiver element is all that is needed to appropriately slide the slider, particularly so that the slider is correspondingly displaced by one half the sliding distance of the cord receiver element to maintain the cord in a kink-free looped arrangement while adjusting its extended length as needed.

An advantageous embodiment of the cord receiver element is in the form of a linear sleeve or sheath tube in which the cord is received. Alternatively, the cord receiver element may comprise a linearly extending sectional profile member that is open along at least one side thereof, e.g. in the form of a C-section member or the like.

In order to increase the sliding security of the respective portions or strands of the electrical cord on the opposite sides of the slider, while maintaining a kink-free sliding support thereof, the inventive arrangement preferably provides guide channels that are bounded and enclosed on all sides thereof. In a simple embodiment of this feature, the bounding walls of the guide channels are formed directly by a floor and cover, and/or side walls, of the magazine chamber. The slider itself also acts as a divider or bounding wall between the two guide channels.

The preferred simplest embodiment of the slider is in the form of a flat slider, namely a flat plate-shaped slider element that is slidingly received and guided along guide tracks or grooves at least along its longitudinal edges on its height axis, i.e. its width dimension, along the floor and cover of the magazine chamber. Correspondingly, the electrical cord is preferably a flat cord arranged with its width dimension or height axis lying approximately parallel to that of the flat slider.

To prevent the electrical cord from kinking or forming an enlarged uncontrollably variable loop at the end of the cord receiver element, i.e. sheath tube, when the sheath tube is slidingly inserted into and extended from the magazine chamber, the first loop of the electrical cord is preferably fixed directly at the end of the sheath tube where the cord exits from the tube into the magazine chamber. This is preferably achieved by a retaining or fixing element such as a cord fixing clip directly on the end of the sheath tube. This cord fixing clip especially forms and retains the loop configuration or bend of the first fixed loop of the cord.

An advantageous embodiment of the magazine chamber involves integrating the magazine chamber directly onto the outer wall of the outer vacuum pipe. Namely, the outer wall of the outer vacuum pipe will then form the floor of the magazine chamber, which is integrally formed as a single component with the pipe. Alternatively, the magazine chamber may be a separate component that is mountable onto the outer vacuum pipe by means of any suitable mounting elements, e.g. screws, rivets, clips, plastic or metal welds, adhesive bonds, etc. In this manner, the magazine chamber may even be retrofitted onto previously existing telescoping vacuum wands.

DESCRIPTION OF THE DRAWINGS

In order that the invention may be clearly understood, it will now be described in connection with example embodiments, with reference to the accompanying drawings, wherein.

Figure 1:
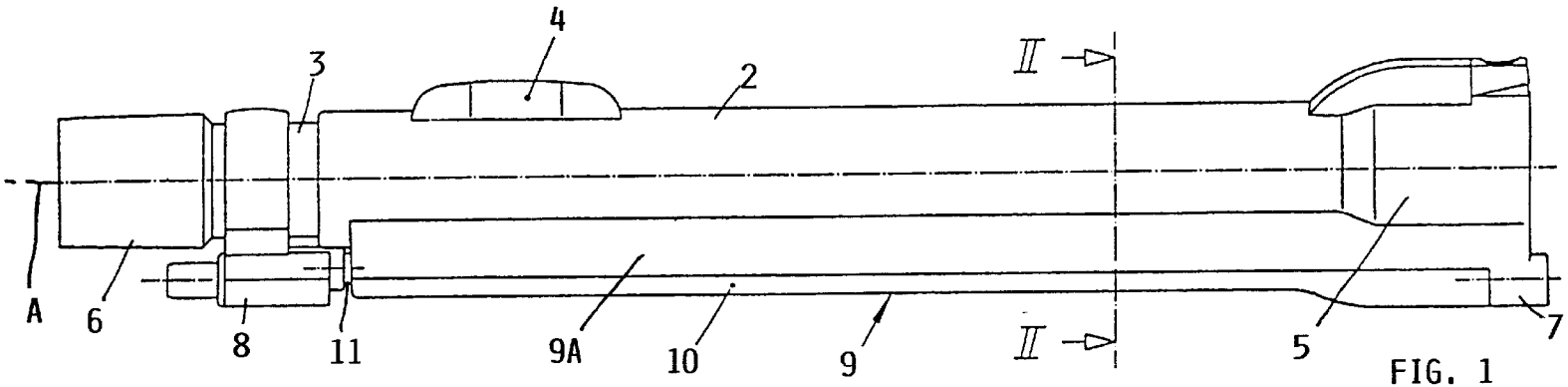
FIG. 1 is a side view of a two-part telescopable vacuum wand according to the invention, in the collapsed condition with the inner vacuum pipe completely slidingly inserted into the outer vacuum pipe.

DETAILED DESCRIPTION OF PREFERRED EXAMPLE EMBODIMENTS AND OF THE BEST MODE OF THE INVENTION

The telescoping vacuum wand 1 illustrated in the drawings comprises an outer vacuum pipe 2 and an inner vacuum pipe 3, which is slidably received in the outer pipe 2, coaxially along a longitudinal axis A. The two vacuum pipes 2 and 3 are telescopably adjustable relative to each other, so as to adjust the overall length of the telescoping vacuum wand 1 along its longitudinal axis A. A desired length adjustment can be locked by a detent or fixing catch 4, for example a spring-loaded ball or lever mounted on one of the vacuum pipes and respectively engaging a selected one of plural holes or recesses provided on the other one of the vacuum pipes. The arrangement of the vacuum pipes 2 and 3 as well as the detent 4 can be according to any conventionally known teachings in this regard.

A wand coupler 6 is provided at the free left end of the inner vacuum pipe 3, namely at a first end of the wand 1, while a wand coupler 5 is provided at the free right end of the outer vacuum pipe 2, namely at a second end of the telescoping vacuum wand 1. These couplers may have any conventionally known configuration, and serve to connect the wand to a vacuum hose, a hand grip, or an accessory device or vacuum tool, or the like. Moreover, a respective electrical connector or coupler 7 and an electrical contact receiver 8 are respectively connected or allocated to the couplers 5 and 6, and are respectively mounted or arranged on the pipes 2 and 3. These electrical connectors may have any conventionally known structure.

According to the invention, a magazine chamber or cord reserve storage chamber 9 is mounted or directly formed onto the outer wall surface of the outer vacuum pipe 2, and is preferably covered by a removable lid or cover 10. The vacuum pipes 2 and 3, as well as the magazine chamber 9 and the cover 10 can be formed of metal, or plastic, or any other conventionally used material in this field, by any conventionally known manufacturing processes. The cover 10 can be secured onto the chamber 9 by screws or the like, schematically indicated at 28 for example.

Figure 3:
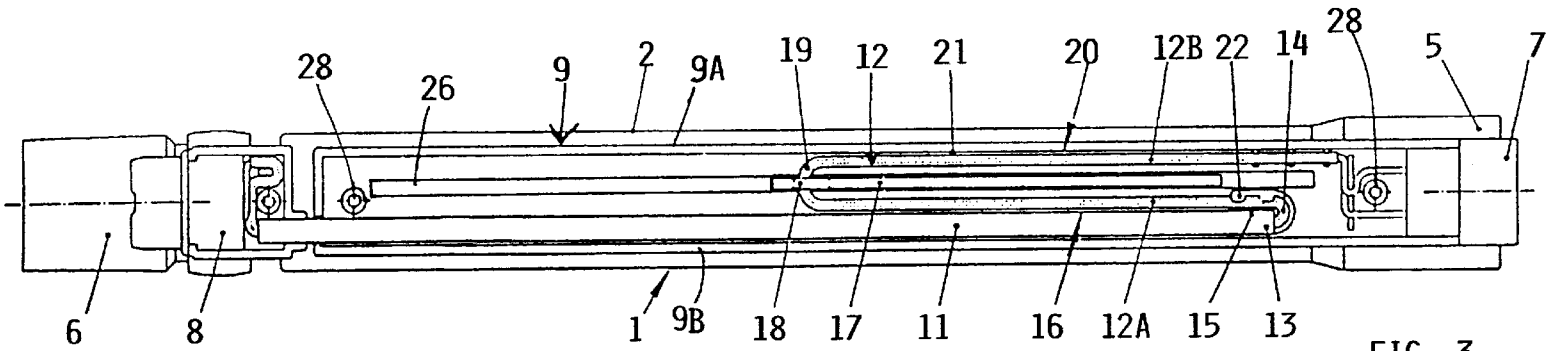
FIG. 3 is a view of the same telescoping vacuum wand shown in FIG. 1, but rotated by 90° about its lengthwise axis, i.e. this view is a bottom view, whereby the magazine chamber cover has been removed for illustration of the components within the chamber.
Figure 4:
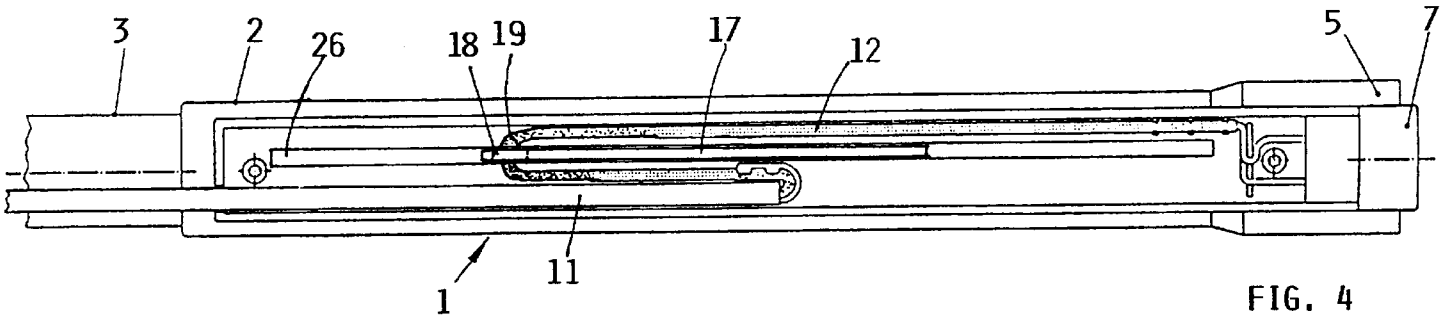
FIG. 4 is a view corresponding to that of FIG. 3, but showing the arrangement in an extended condition, in which the inner vacuum pipe has been slidingly extended out of the outer vacuum pipe.
Figure 2:
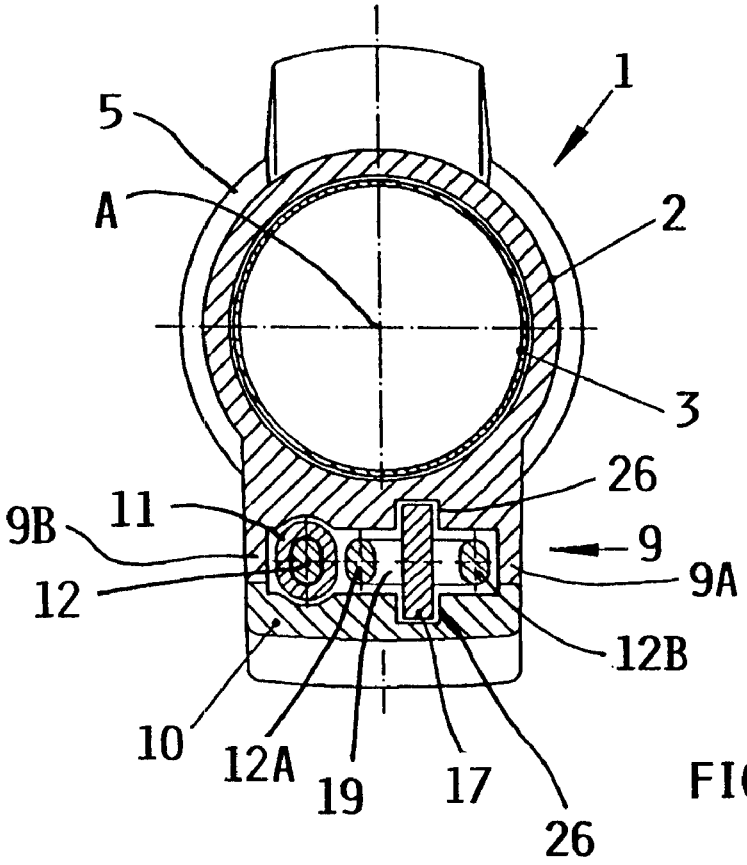
FIG. 2 is a cross-section along line II—II of FIG. 1.

As especially shown in FIGS. 2, 3 and 4, the chamber 9 is bounded by chamber side walls 9A and 9B, and a chamber floor formed by the outer wall of the outer vacuum pipe 2 itself. On one side of the magazine chamber 9, namely along the chamber side wall 9B, a cord receiver element in the form of a sleeve or sheath tube 11 is slidingly received and guided. An outer end of the sheath tube 11 is fixedly connected to the wand coupler 6 at the end of the inner vacuum pipe 3. More particularly, the outer end of the sheath tube 11 is connected to the electrical contact receiver 8. Thus, the sheath tube 11 moves longitudinally along with the inner vacuum pipe 3 along the lengthwise axis A thereof. Accordingly, the sheath tube 11 will slidingly telescope into or out of the magazine chamber 9 as the inner vacuum pipe 3 correspondingly slidingly telescopes into or out of the outer vacuum pipe 2.

Generally on a side of the magazine chamber 9 opposite the sheath tube 11, i.e. offset from the lengthwise center line of the chamber 9 closer toward the chamber side wall 9A, a slider 17 is arranged and slidingly guided along a guide track or groove 26 that is formed in at least one of the outer wall of the outer vacuum pipe 2 forming the floor of the magazine chamber 9, and the inner surface of the cover 10. Preferably, corresponding guide grooves 26 are formed on both the floor of the chamber 9 and on the inner surface of the cover 10, to correspondingly guidingly receive the lateral longitudinal edges of the slider 17 therein. Thereby, the slider 17 is free to slide along the grooves 26 in a direction parallel to the lengthwise axis A and thus parallel to the sheath tube 11. The slider 17 is preferably simply a flat plate slider of metal or preferably a plastic. The slider has a cord guide 18 such as a guide eyelet or opening 18 therein or at an end thereof. The opening may be a simple hole or may further include a rim or guide grommet or the like. A first guide channel 16 is formed between the sheath tube 11 and a first side of the slider 17. A second guide channel 20 is formed between the opposite second side of the slider 17 and the chamber side wall 9A forming a boundary 21 of the channel 20.

Figure 5:
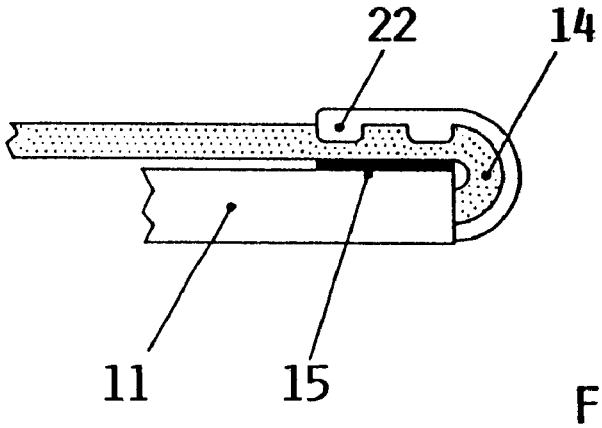
FIG. 5 is a detail view of the fixing element for fixing a loop of the electrical cord, as seen generally in FIGS. 3 and 4.

An electrical cable or cord 12 (e.g. any conventionally known electrical conductor cable), preferably in the form of a flat cord 12, is suitably electrically and mechanically connected to the electrical contact receiver 8. From there, the flat cord 12 extends through and along the sheath tube 11 until it exits from the opposite free terminal end 13 of the sheath tube 11 extending into the magazine chamber 9. As it extends along the interior of the sheath tube 11, the flat cord 12 extends in a first longitudinal direction toward the right of FIGS. 3 and 4. Upon exiting from the free terminal end 13 of the sheath tube 11, the flat cord 12 loops or bends back by essentially 180° into the second longitudinal direction opposite the first longitudinal direction, yet also parallel to the lengthwise axis A. At this location at the free terminal end 13 of the sheath tube 11, the flat cord 12 is secured to an end portion 15 of the sheath tube 11, so as to form a fixed loop 14 of the flat cord 12. Preferably, the loop 14 of the flat cord 12 is retained and fixed by a fixing element 22 such as a cord fixing clip 22 that positively forms, supports, and maintains the fixed loop 14 configuration at the end 13 of the sheath tube 11. An example of such a fixing element 22 is shown in detail in FIG. 5, and can be a separate clip element that is clipped onto the end of the sheath tube 11, or it may be integrally formed with the sheath tube 11.

It should be understood that the flat cord 12 is arranged with its width direction or height axis extending on a plane parallel to the plane of the width dimension or height axis of the flat plate slider 17, as the cord 12 extends along the guide channel 16 between the sheath tube 11 and the first side of the slider 17, parallel to the lengthwise axis A. The dimensions of the guide channel 16 between the sheath tube 11 and the slider 17, and between the floor of the magazine chamber 9 and the cover 10 are selected appropriately so that the flat cord 12 is positively received and supported, yet still slidable in a kink-free manner and without being pinched or clamped into the guide channel 16 (see FIG. 2). Moreover, the guide channel 16 is bounded or enclosed on all sides, so that the flat cord 12 is positively maintained within the guide channel 16 and cannot improperly bulge, slide, or otherwise move out of the channel 16. In this manner, a sliding displacement of the sheath tube 11 necessarily slidingly displaces the strand or portion 12A of the cord 12 in the guide channel 16 along with the sheath tube 11, through the fixing clip 22, for example. Since the cord portion 12A is positively constrained in the guide channel 16, in the manner of a push-pull cable, thereby, a sliding force (pushing thrust or pulling tension) is transmitted to and through the flat cord 12.

Next, the flat cord 12 is further arranged and deflected through the cord guide such as the eyelet opening 18 in the slider 17, to form a second movable or unfixed loop 19 that bends or loops back about 180°, from the second longitudinal direction back into the first longitudinal direction. From there, the flat cord 12 continues with a second strand or portion thereof 12B extending along the guide channel 20 between the flat slider 17 and the chamber side wall 9A. This guide channel 20, like the guide channel 16, is dimensioned appropriately so that the flat cord 12 is supported therein in a kink-free manner. The guide eyelet opening 18 in the slider 17 is dimensioned appropriately so that the flat cord 12 can slidingly move through this opening 18. The strand or portion 12B of the flat cable 12 continues in the first longitudinal direction parallel to the lengthwise axis A toward the second end of the wand, where it is electrically and mechanically connected to the electrical connector or coupler 7 mounted on or connected to the wand coupler 5 at the free end of the outer vacuum pipe 2. The cord portion 12B does not slide in the channel 20, but rather remains fixed relative to the chamber 9 in this channel 20. The slider 17 slides relative to the cord portion 12B, as the cord selectively "rolls" or moves to a greater or lesser extent through the guide opening 18 into the guide channel 20, depending on the sliding position of the slider 17. In other words, the length of the cord portion 12B in the guide channel 20 depends on the position of the slider 17.

With the above arrangement, the flat cord 12 is thus positively guided in the guide channels 16 and 20 in a sliding and/or rolling manner, which could also be called a block-and-tackle manner, during a telescoping sliding of the vacuum pipes 2 and 3 relative to each other. Thereby, the appropriate extended cable length as required for any given telescoping length adjustment of the telescoping vacuum wand 1 will always be automatically adjusted and provided.

Namely, when the inner vacuum pipe 3 is pulled out of and thereby extended relative to the outer vacuum pipe 2, simultaneously the sheath tube 11 is correspondingly slidingly pulled out of the magazine chamber 9, whereby the sheath tube 11 correspondingly slidingly pushes the strand or portion 12A of the flat cord 12 in the second longitudinal direction (toward the left in FIGS. 3 and 4) along with the sliding of the sheath tube 11. As a result, the moving strand or portion 12A of the flat cable 12 necessarily pushes along the slider 17, also in the second longitudinal direction, for example by transmitting thrust forces along the cord portion 12A and pushing against the eyelet opening 18 in the area of the moving loop 19 of the cord 12, and/or by frictionally transmitting sliding forces from the sheath tube 11 through the cord portion 12A to the slider 17. In this process, the slider 17 will slidingly travel approximately one half the sliding distance traversed by the sheath tube 11 in the same direction, because the slider 17 acts as a moving block of a block-and-tackle arrangement. Thereby, the degree of overlap between the slider 17 and the sheath tube 11 is reduced, and the cord 12 correspondingly moves through the guide eyelet opening 18, so that the degree of overlap or looping-back of the two portions 12A and 12B of the cord 12 is also correspondingly reduced. As a result, the extending length of the cord 12 arrangement in the longitudinal direction is increased.

On the other hand, the opposite process will be carried out when the inner vacuum pipe 3 is slidingly moved into the outer vacuum pipe 2 in order to achieve a shorter adjusted length of the telescoping vacuum wand 1. Namely, the sheath tube 11 will slide further into the magazine chamber 9, whereby it pulls along the first strand or portion 12A of the flat cord 12, thereby applying tension forces to the flat cord 12, and transmitting these tension forces through the cord 12 to the eyelet opening 18 and thus onto the slider 17. Accordingly, the moving cord 12 will slidingly pull along the slider 17 in the first longitudinal direction (toward the right in FIGS. 3 and 4) while shifting the arrangement to a greater degree of overlap between the slider 17 and the sheath tube 11, and a greater overlap or looping-back of the first strand or portion 12A relative to the second strand or portion 12B of the flat cord 12, thereby shortening the longitudinal extending length of the cord arrangement.

Figure 3A:
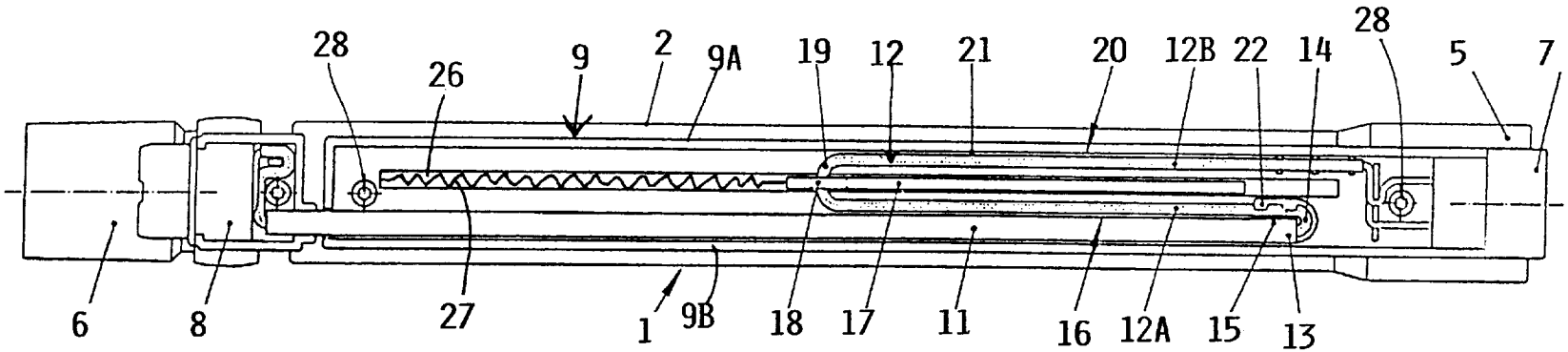
FIG. 3A is similar to FIG. 3, but shows an alternative option.

The above sliding displacements can all be achieved without requiring any other means for moving the slider 17, because the kink-preventing guidance of the flat cord 12 necessarily causes the slider 17 to slide along with the shifting cord 12 due to the moving loop 19 of the cord 12 passing and moving through the opening 18 of the slider 17. As an option, a biasing spring 27 may be connected to the slider 17, to urge the slider 17 in the second longitudinal direction (i.e. the left in FIGS. 3, 3A and 4). This further helps to ensure the kink-free sliding of the cord 12, because then it will only be necessary to apply and transmit tension or pulling forces through the cord 12, without having to transmit thrust or pushing forces through the cord 12. Such a spring 27 is schematically shown as an option in FIG. 3A, but preferably is entirely omitted (FIGS. 3, 4).

The slider 17 preferably has a length in the longitudinal direction sufficient to ensure that the slider can always form an effective divider between the two cord guide channels 16 and 20 and prevent the cord 12 from crossing between the two channels (other than through the cord guide opening 18). The slider 17 should not be so long, however, that it cannot slide a sufficient distance within the chamber 9. For example, the slider has a length in the range from 35 to 55% of the length of the chamber 9 in the longitudinal direction. To ensure that the cord receiver element 11 can telescopingly adjust in the chamber 9 over substantially the same range as the telescoping adjustment of the vacuum pipes 2 and 3, the receiver element 11 preferably has a length of at least 85% of the length of each one of the pipes 2 and 3.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A telescoping vacuum wand for a vacuum cleaner, comprising:

a telescoping wand body including an inner vacuum pipe variably slidably received at least partly within an outer vacuum pipe coaxially along a longitudinal axis;

a cord magazine chamber provided on said outer vacuum pipe;

a slider with a cord guide opening, arranged slidable parallel to said longitudinal axis in said magazine chamber;

a cord receiver element that is fixed relative to said inner vacuum pipe and extends variably slidably into said magazine chamber parallel to said longitudinal axis on a first side of said slider; and an electrical cord with a first cord end fixed relative to said inner vacuum pipe, a second cord end fixed relative to said outer vacuum pipe, a first loop bend fixed to a free end of said cord receiver element in said magazine chamber, a second loop bend passing through said cord guide opening of said slider, a first cord portion extending from said first cord end along said cord receiver element to said first loop bend, a second cord portion extending from said first loop bend to said second loop bend between said cord receiver element and said slider, and a third cord portion extending from said second loop bend toward said second cord end on a second side of said slider opposite said cord receiver element.

2. The telescoping vacuum wand according to claim 1, wherein said first loop bend and said second loop bend are each respectively a bend of 180°, and wherein said first cord portion, said second cord portion and said third cord portion are all parallel to each other and to said longitudinal axis, so that said electrical cord has an overall generally S- or Z-shaped meandering shape.

3. The telescoping vacuum wand according to claim 1, wherein a first cord guide channel is formed and bounded between said cord receiver element and said first side of said slider, a second cord guide channel is formed and bounded between said second side of said slider and a wall portion of said magazine chamber, said second cord portion extends along in said first cord guide channel constrained with sliding free play therein in a kink-free manner, and said third cord portion extends along in said second cord guide channel constrained with free play therein in a kink-free manner.

4. The telescoping vacuum wand according to claim 3, wherein each one of said cord guide channels is further bounded respectively between a bottom bounding wall and a top bounding wall so that each one of said cord guide channels is enclosed on all sides.

5. The telescoping vacuum wand according to claim 4, wherein said magazine chamber comprises side walls and a cover arranged on said side walls, said bottom bounding wall is formed by an outer wall of said outer vacuum pipe, said top bounding wall is formed by said cover, and said wall portion bounding said second cord guide channel is formed by one of said side walls.

6. The telescoping vacuum wand according to claim 3, wherein said first cord guide channel is dimensioned relative to said second cord portion so as to constrain said second cord portion with sliding free play in said first cord guide channel in such a manner that said second cord portion can transmit pulling tension forces and pushing thrust forces therealong without kinking while sliding respectively in opposite directions therein.

7. The telescoping vacuum wand according to claim 1, wherein said first cord portion is fixed relative to and along said cord receiver element.

8. The telescoping vacuum wand according to claim 1, wherein said cord receiver element comprises a hollow sheath tube within which said first cord portion extends along.

9. The telescoping vacuum wand according to claim 1, wherein said cord receiver element comprises an elongate sectional profile member that is open along at least one side thereof and that has an open hollow center sectional area within which said first cord portion extends along.

10. The telescoping vacuum wand according to claim 1, wherein said cord receiver element is a linear elongate element having a length equal to at least 85% of a length of said magazine chamber parallel to said longitudinal axis.

11. The telescoping vacuum wand according to claim 10, wherein said length of said magazine chamber corresponds to and extends along at least 85% of a length of said outer vacuum pipe parallel to said longitudinal axis.

12. The telescoping vacuum wand according to claim 1, wherein said cord guide opening is dimensioned with sliding free play clearance relative to said second loop bend and allows said second loop bend to slidingly shift through said cord guide opening.

13. The telescoping vacuum wand according to claim 1, wherein said slider is an elongated flat plate-shaped member, and said cord guide opening is formed by a hole in said plate-shaped member.

14. The telescoping vacuum wand according to claim 13, wherein said hole is located adjacent to an end of said slider oriented opposite and away from said free end of said cord receiver element in said magazine chamber.

15. The telescoping vacuum wand according to claim 13, wherein said slider has a length corresponding to 35 to 55% of a length of said magazine chamber parallel to said longitudinal axis.

16. The telescoping vacuum wand according to claim 1, wherein said magazine chamber includes slide guides therein extending parallel to said longitudinal axis, said slider is a flat plate-shaped slider and is slidingly supported and guided by said slide guides, and a slider plane on which said flat plate-shaped slider extends is oriented coplanar with or parallel to a plane on which said longitudinal axis lies and which passes through a center of said magazine chamber.

17. The telescoping vacuum wand according to claim 16, wherein said electrical cord is a flat cord, with a major axis of a cross-section respectively of said second cord portion and said third cord portion of said flat cord being oriented parallel to said slider plane.

18. The telescoping vacuum wand according to claim 1, further comprising a spring that is connected to said slider and biases said slider parallel to said longitudinal axis in a direction toward said first cord end fixed relative to said inner vacuum pipe.

19. The telescoping vacuum wand according to claim 1, excluding any spring member and any coupling member connected to said slider, wherein said slider is freely slidable in said magazine chamber except for said second loop bend passing through said cord guide opening.

20. The telescoping vacuum wand according to claim 1, wherein a telescoping sliding of said inner vacuum pipe relative to said outer vacuum pipe correspondingly causes a sliding of said cord receiver element relative to said magazine chamber, which in turn slidingly moves said second cord portion along with said cord receiver element and exerts a sliding force onto said slider via at least said second loop bend, which in turn causes said slider to slide and said second loop bend to shift through said cord guide opening, which causes a change in an extension length of said electrical cord measured linearly between said first cord end and said second cord end.

21. The telescoping vacuum wand according to claim 1, further comprising a first electrical coupler arranged on said inner vacuum pipe and a second electrical coupler arranged on said outer vacuum pipe, wherein said first cord end is mechanically and electrically connected to said first electrical coupler and said second cord end is mechanically and electrically connected to said second electrical coupler.

22. The telescoping vacuum wand according to claim 1, further comprising a cord retaining and fixing element that is arranged at said free end of said cord receiver element in said magazine chamber, and that fixes said first loop bend to said free end of said cord receiver element and retains and constrains a bent shape of said first loop bend.

23. The telescoping vacuum wand according to claim 1, wherein said magazine chamber includes at least chamber side walls that are integrally formed with a pipe wall of said outer vacuum pipe as a one-piece integral component.

24. The telescoping vacuum wand according to claim 1, further comprising releasable fasteners, wherein said magazine chamber is removably mounted on said outer vacuum pipe by said releasable fasteners.

25. A telescoping vacuum wand for a vacuum cleaner, comprising:

an outer vacuum pipe extending along a longitudinal axis;

an inner vacuum pipe that is telescopingly slidably arranged at least partially in said outer vacuum pipe, coaxially along said longitudinal axis;

a cord magazine chamber that is provided on said outer vacuum pipe and that has respective opposite first and second chamber ends spaced apart from each other along said longitudinal axis;

a slider that is arranged slidably in said magazine chamber so as to be slidable back-and-forth parallel to said longitudinal axis, and that has a cord guide opening therein;

a cord receiver element having a fixed end that is fixed to said inner vacuum pipe and a free end that is located in said magazine chamber, wherein said cord receiver element extends into said magazine chamber at said first chamber end thereof with said free end of said cord receiver element extending toward said second chamber end, and wherein said cord receiver element is slidably arranged relative to said magazine chamber to be selectively slidable farther out of and farther into said magazine chamber parallel to said longitudinal axis on a first side of said slider; and an electrical cord having a first cord end fixed to said inner vacuum pipe and a second cord end fixed to said outer vacuum pipe, wherein said electrical cord includes a first cord portion extending along said cord receiver element from said fixed end to said free end of said cord receiver element, a fixed cord loop fixed to said free end of said cord receiver element, a movable cord loop passing through said cord guide opening in said slider, a second cord portion extending from said fixed cord loop to said movable cord loop in a first guide channel between said slider and said cord receiver element on said first side of said slider, and a third cord portion extending from said movable cord loop to said second cord end in a second guide channel on a second side of said slider opposite said first side of said slider.

* * * * *